US008327503B2

(12) United States Patent
Worker et al.

(10) Patent No.: US 8,327,503 B2
(45) Date of Patent: Dec. 11, 2012

(54) SURFACE TREATING APPLIANCE

(75) Inventors: David Colin Worker, Malmesbury (GB); Nicholas Timothy Spence, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 688 days.

(21) Appl. No.: 12/443,654

(22) PCT Filed: Sep. 14, 2007

(86) PCT No.: PCT/GB2007/003496

§ 371 (c)(1),
(2), (4) Date: Aug. 6, 2009

(87) PCT Pub. No.: WO2008/037955

PCT Pub. Date: Apr. 3, 2008

(65) Prior Publication Data

US 2010/0088842 A1 Apr. 15, 2010

(30) Foreign Application Priority Data

Sep. 29, 2006 (GB) ..... 0619181.1

(51) Int. Cl.
*A47L 5/00* (2006.01)
*A47L 9/00* (2006.01)

(52) U.S. Cl. ..... 15/336; 15/331; 15/334; 15/335

(58) Field of Classification Search ..... 15/329, 15/331, 334, 335, 336, 411; *A47L 5/00, 9/00*
See application file for complete search history.

(56) References Cited

U.S. PATENT DOCUMENTS

| | | | |
|---|---|---|---|
| 2,644,976 | A | 7/1953 | Osborn |
| 4,156,952 | A | 6/1979 | Lynch, Jr. |
| 5,351,361 | A | 10/1994 | Buchtel |
| 5,560,074 | A | 10/1996 | Graham et al. |
| 2003/0024068 | A1 | 2/2003 | Tucker |
| 2006/0143852 | A1 | 7/2006 | Lee et al. |
| 2010/0095477 | A1 | 4/2010 | Worker et al. |
| 2010/0236015 | A1 | 9/2010 | Worker et al. |

FOREIGN PATENT DOCUMENTS

| | | | |
|---|---|---|---|
| EP | 1 121 889 | A | 8/2001 |
| GB | 680315 | | 10/1952 |
| GB | 2 325 399 | A | 11/1998 |

(Continued)

OTHER PUBLICATIONS

GB Search Report dated Dec. 19, 2006, directed to counterpart GB Patent Application No. 0619181.1; 1 page.

(Continued)

*Primary Examiner* — David Redding
(74) *Attorney, Agent, or Firm* — Morrison & Foerster LLP

(57) ABSTRACT

A surface treating appliance, such as a vacuum cleaner, includes a device generating a flow of fluid in the form of a motor and fan, housed in a main body. A hose and wand assembly, a surface treating head and a rotary change over valve are also provided. The valve is selectively rotatable so as to allow fluid flow from either the surface-treating head or the hose. A support assembly is moveable between a supporting position, in which it supports the main body, and a retracted position. The change over valve and support assembly are arranged so that motion of the support assembly between the supporting and retracted positions induces rotary motion of the change over valve.

27 Claims, 15 Drawing Sheets

FOREIGN PATENT DOCUMENTS

| | | | |
|---|---|---|---|
| GB | 2 403 134 | A | 12/2004 |
| GB | 2 422 094 | A | 7/2006 |
| JP | 11-178756 | | 7/1999 |
| JP | 2001-204653 | A | 7/2001 |

OTHER PUBLICATIONS

GB Search Report dated Jun. 14, 2007, directed to counterpart GB Patent Application No. 0619181.1; 1 page.

International Search Report and Written Opinion, mailed Jan. 17, 2008, mailed to International Patent Application No. PCT/GB2007/003500; 11 pages.

International Preliminary Report on Patentability, mailed Jan. 20, 2009, mailed to International Patent Application No. PCT/GB2007/003500; 7 pages.

International Search Report and Written Opinion, mailed on Dec. 17, 2007, directed to International Patent Application No. PCT/GB2007/003528; 13 pages.

International Search Report and Written Opinion, mailed on Jan. 17, 2008, counterpart International Patent Application No. PCT/GB2007/003496; 9 pages.

Worker et al., U.S. Office Action mailed Feb. 14, 2012, directed to U.S. Appl. No. 12/443,667; 10 pages.

Worker et al., Office Action mailed May 31, 2012, directed to U.S. Appl. No. 12/443,667; 8 pages.

SURFACE TREATING APPLIANCE

REFERENCE TO RELATED APPLICATIONS

This application is a national stage application under 35 USC 371 of International Application No. PCT/GB2007/003496, filed Sep. 14, 2007, which claims the priority of United Kingdom Application No. 0619181.1, filed Sep. 29, 2006, the contents of both of which prior applications are incorporated herein by reference.

FIELD OF THE INVENTION

This invention relates to a surface treating appliance, such as a vacuum cleaner.

BACKGROUND OF THE INVENTION

Surface treating appliances such as vacuum cleaners and floor polishers are well known. The majority of vacuum cleaners are either of the 'upright' type or of the 'cylinder' type, called canister or barrel cleaners in some countries. A typical upright vacuum cleaner comprises a main body which houses the main components of the vacuum cleaner, such as a motor and fan for drawing dirty air into the machine and some form of separating apparatus for separating dirt, dust and other debris from a dirty airflow drawn in by the fan. The main body also houses filters for trapping fine particles in the cleaned airflow. A cleaner head is rotatably mounted to the lower end of the main body. A supporting wheel is mounted on each side of the lower part of the main body, in a fixed relationship to the main body. In use, a user reclines the main body of the vacuum cleaner and then pushes and pulls a handle which is fixed to the main body of the cleaner. The vacuum cleaner rolls along the floor surface on the supporting wheels.

A dirty-air inlet is located on the underside of the cleaner head. Dirty air is drawn into the dust separating apparatus via the dirty-air inlet by means of the motor-driven fan. When the dirt and dust entrained within the air has been separated from the airflow in the separating apparatus, air is conducted to the clean air outlet by a second air flow duct, and via one or more filters, and expelled into the atmosphere.

Conventional upright vacuum cleaners have a disadvantage in that they can be difficult to manoeuvre about an area in which they are used. They can be pushed and pulled easily enough, but pointing the cleaner in a new direction is more difficult. It has been proposed to make an upright vacuum cleaner more manoeuvrable by substituting a wide rolling support for the supporting wheels, such as is described in our patent application GB2422094. A support assembly is provided to give further support to the main body when in the vertical position. The support assembly is moveable between a supporting position, in which it supports the main body of the appliance, and a stored position, in which it lies substantially against the main body. The support assembly is released from its supporting position by a user-operable foot pedal.

SUMMARY OF THE INVENTION

The invention provides a surface treating appliance comprising means for generating a flow of fluid, a main body, a hose, a surface treating head and a rotary change over valve, the valve being selectively rotatable so as to allow fluid flow from either the surface-treating head or the hose, and a support assembly moveable between a supporting position, in which it supports the main body, and a retracted position, the change over valve and support assembly being arranged so that motion of the support assembly between the supporting and retracted positions induces rotary motion of the change over valve.

Conventionally, movement of the change over valve between its positions has been effected by moving the main body between a vertical and a reclined position. In the aforementioned GB2422094, movement of the main body itself influences the movement of an actuator mechanism, which, in turn, repositions the change over valve. By providing for movement of the support assembly to be translated into movement of the change over valve, a more direct and positive movement between the two valve positions can be achieved.

Preferably, the rotary change over valve comprises a drum rotatable about its longitudinal axis and having an internal passage extending between its circumference and one end.

The support assembly preferably comprises a stand arranged to engage with a floor surface in the supporting position and to be pivotably moveable between the supporting and retracted positions.

The stand and change over valve are arranged so that pivoting motion of the stand is translated into rotational motion of the change over valve. This may be effected by an arrangement similar to a Geneva drive. A pin on the stand is arranged to engage with a slot on a wheel on the change over valve.

Advantageously, the appliance has a rolling support assembly comprising a plurality of rollers arranged relative to one another to define a region into which components of the appliance are mountable, such as the change over valve, and/or at least some of the components of the support assembly when in the retracted position.

These aspects of the invention are particularly suitable for inclusion in upright vacuum cleaners having a wide, ball-like rolling support assembly, but may be applied to more conventional upright cleaners and other domestic appliances.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
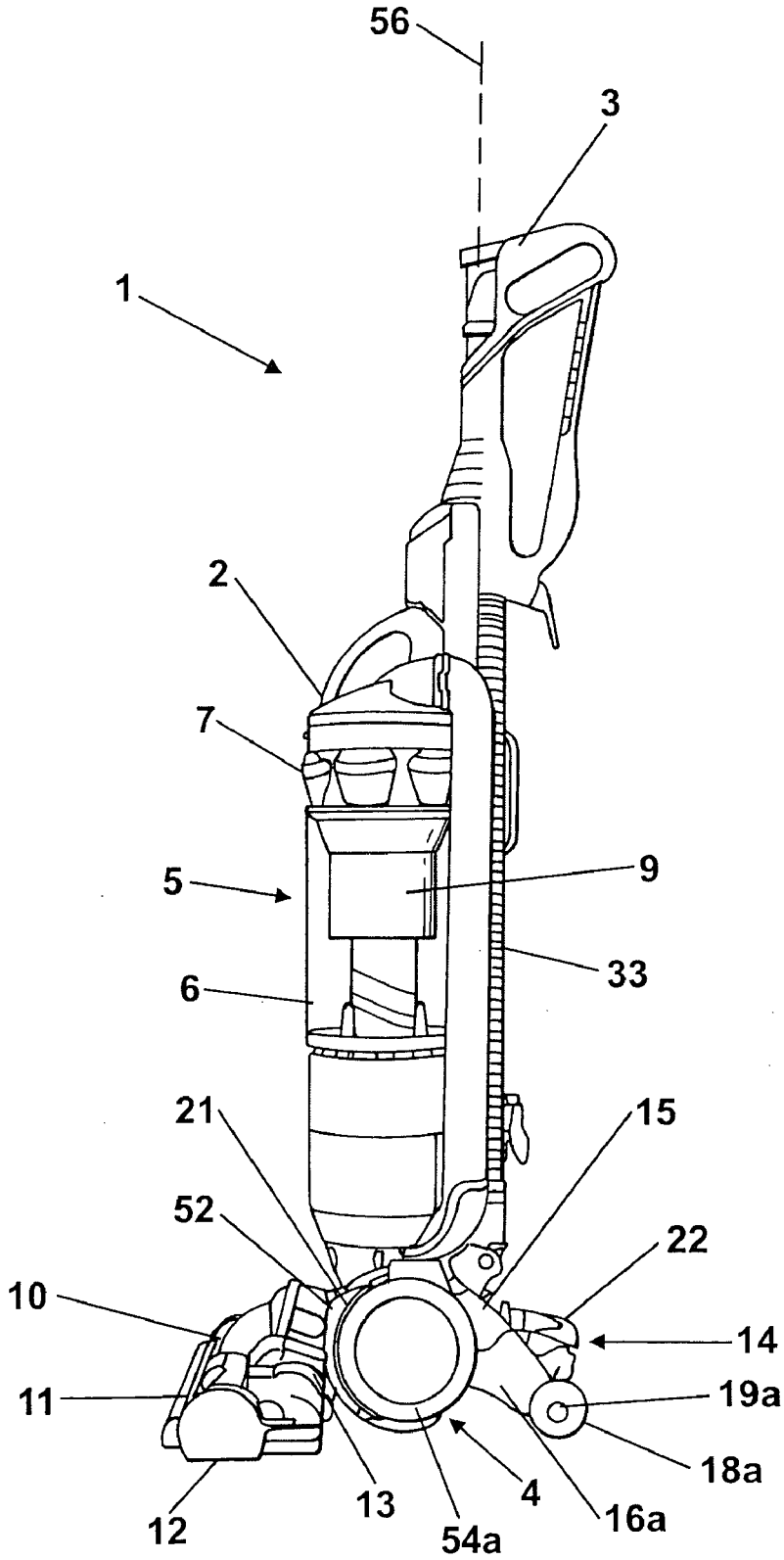
FIG. 1 is a side view of a surface-treating appliance constructed according to the invention.
Figure 2:
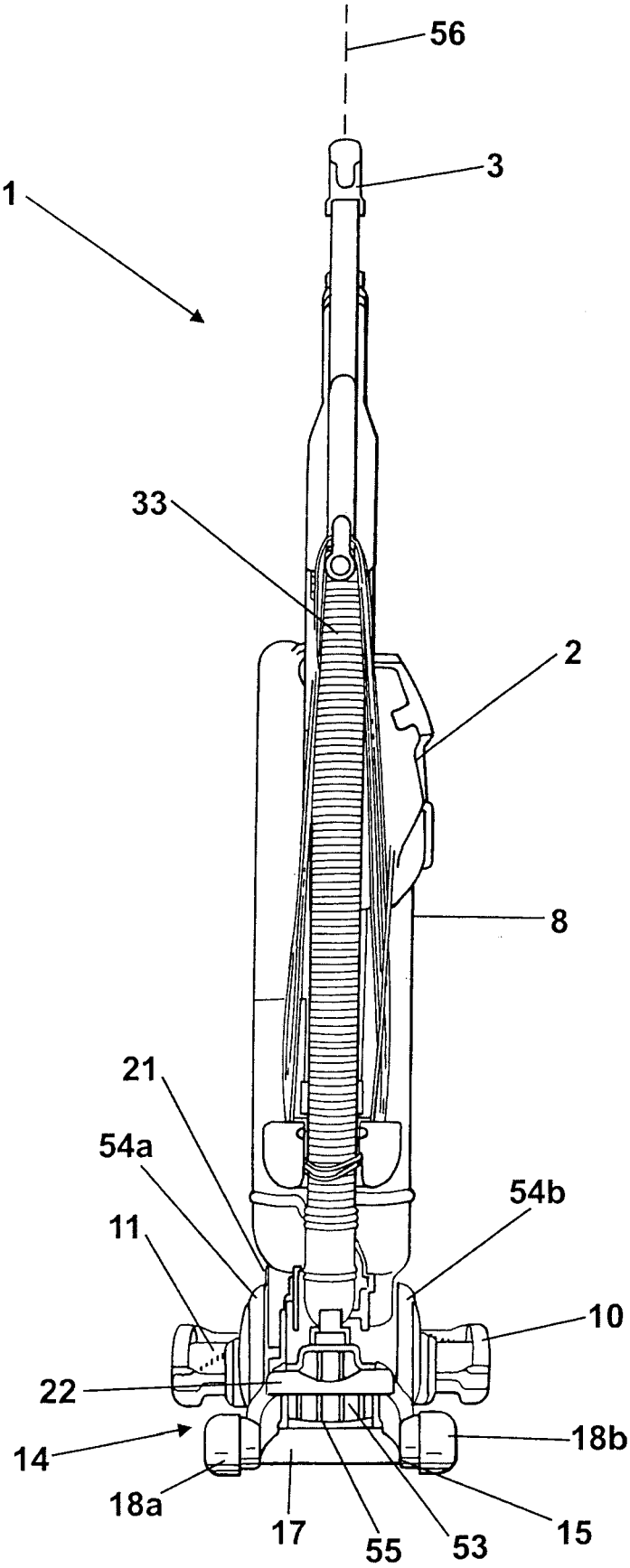
FIG. 2 is a rear view of the appliance of FIG. 1.

With reference to FIGS. 1 and 2, the surface treating appliance is shown in the form of a vacuum cleaner and is indicated generally by the reference numeral 1. The vacuum cleaner 1 comprises a main body 2, a user-operable handle 3 and a roller assembly 4 for rolling the cleaner along a floor surface. The handle 3 extends upwardly from the rear part of the main body 2. The main body 2 houses a motor and fan for generating a suction airflow (not visible in these drawings) as well as separating apparatus 5 for separating dirt, dust and other debris from a dirty airflow drawn into the machine by the fan and motor.

In this embodiment, the separating apparatus 5 is cyclonic, in which the dirt and dust is spun from the airflow. The cyclonic separating apparatus 5 comprises two stages of cyclone separation arranged in series with one another. The first stage is a cylindrically-walled chamber 6 and the second stage comprises a set 7 of tapering, substantially frusto-conically shaped chambers arranged in parallel with one another. Airflow is directed tangentially into the upper part of a first cyclonic chamber 6 by a duct 8. Larger debris and particles are removed and collected in the first cyclonic chamber 6. The airflow then passes through a shroud 9 to the set 7 of smaller frusto-conically shaped cyclonic chambers. Finer dust is separated by these chambers and the separated dust is collected in a common collecting region.

The main body 2 also houses filters (not visible in these drawings) for trapping fine particles in the cleaned airflow. These filters remove any fine particles of dust which have not already been removed from the airflow by the separating apparatus. A first filter, called a pre-motor filter, is provided before the motor and fan. A second filter, called a post-motor filter, is provided after the motor and fan. Where the motor for driving the suction fan has carbon brushes, the post-motor filter also serves to trap any carbon particles emitted by the brushes. Clean air is then expelled to the atmosphere.

A cleaner head 10 is pivotably mounted to the lower end of the main body 2, and serves, in use, to treat the floor surface. In this embodiment, it comprises a housing with a chamber for supporting an agitator in the form of a brush bar 11. The lower, floor-facing side of the chamber has an air inlet slot 12 and the brush bar 11 is rotatably mounted in the chamber such that bristles on the brush bar can protrude through the inlet slot and can agitate the floor surface over which the cleaner head passes. The brush bar 11 is rotatably driven by a dedicated motor 13 positioned on the cleaner head 10.

The roller assembly 4 permits the cleaner to be manoeuvred easily along a floor surface. However, the roller assembly 4 may not provide sufficient support for the cleaner when the main body 2 is in the vertical, or substantially vertical position. To this end, a support assembly 14 is provided.

Figure 4:
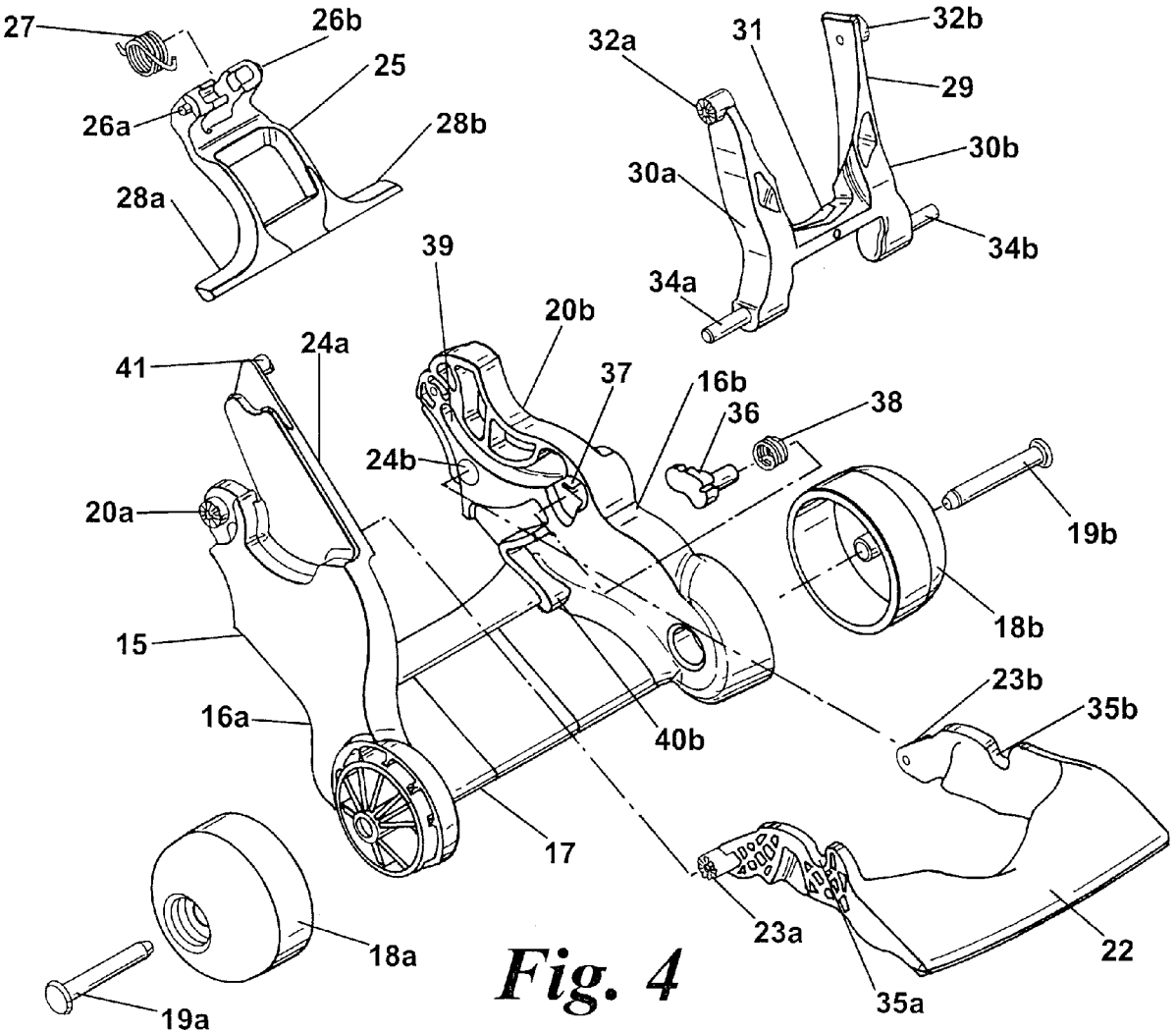
FIG. 4 is an exploded view of components of the support assembly of the appliance of FIGS. 1 to 3.

FIG. 4 is an exploded view of the main components of the support assembly 14. Minor features such as fasteners and washers have been omitted for clarity. The support assembly 14 comprises a stand 15 shaped so as to form two legs 16*a*, 16*b*, with a strut 17 therebetween to provide structural strength to the stand 15. Each of the legs 16*a*, 16*b*, has a wheel 18*a*, 18*b* attached to an end portion. The wheels 18*a*, 18*b* aid a user in guiding the cleaner 1 between rooms. In this embodiment, each of the wheels 18*a*, 18*b* is wide and the face furthest from the leg 16*a*, 16*b* is rounded. This gives smooth running on a variety of floor surfaces. Each wheel 18*a*, 18*b* is attached to a respective leg 16*a*, 16*b* by axles 19*a*, 19*b* such that the wheels are outside the legs of the stand 15. This provides a wide wheel-base for extra stability.

The end portion of the stand 15 remote from the wheels 18*a*, 18*b* has outwardly facing pins 20*a*, 20*b*, only one of which (20*a*) is visible in this drawing. The pins 20*a*, 20*b* are arranged to engage in apertures on a yoke 21 associated with the main body 2 of the cleaner 1 so that the stand 15 is attached to the yoke, and can move pivotably with respect to the main body.

The support assembly 14 also comprises a pedal 22, which is intended to be depressible by the user's foot. The pedal 22 extends between the legs 16*a*, 16*b* of the stand 15, above the strut 17. The pedal 22 has outwardly-facing pins 23*a*, 23*b*, which engage with recesses 24*a*, 24*b* on the inwardly-facing surface of the stand 15, so that the pedal 22 is pivotable with respect to the stand.

Another component of the support assembly 14 is an actuator 25, which is approximately T-shaped. The end of the actuator 25 that corresponds with the foot of the T has outwardly-facing pins 26*a*, 26*b* that are arranged to engage in apertures (not shown) on the main body 2. Thus, the actuator 25 is pivotable with respect to the main body 2. Resilient means in the form of a helical spring 27 is also provided between the actuator 25 and the main body 2, and is biased so that the actuator tends to pivot upwardly, with the arms 28*a*, 28*b* of the T uppermost. Ordinarily, when the support assembly 14 is supporting the main body 2 of the cleaner 1, the actuator 25 is arranged to bear against a lower surface of the foot pedal 22, thereby urging it upwardly, so that it stands proud of the stand 15. Thus, the pedal 22 is conspicuous to the user.

The support assembly 14 also comprises a locking member 29, which is provided to give further support for the cleaner 1. The locking member 29 comprises two legs 30*a*, 30*b*, with a reinforcing strut 31 therebetween. One end portion of each leg 30*a*, 30*b* has an outwardly-facing projection 32*a*, 32*b* that engages in respective apertures (not shown) on the main body 2, close to the bottom of the hose 33 on the rear of the cleaner 1. Thus, the locking member 29 is pivotable with respect to the main body 2. The other end portion of each leg 30*a*, 30*b* has outwardly facing locking-pins 34*a*, 34*b*. Ordinarily, when the support assembly 14 is supporting the main body 2 of the cleaner 1, the locking pins 34*a*, 34*b* engage with co-operating notches 35*a*, 35*b* on the foot pedal 22. Thus, the foot pedal 22, being urged into a predetermined position by the sprung actuator 25, engages the locking member 29 in a position where it provides support for the main body 2 of the cleaner 1.

Other features of the support assembly 14 include a locking pin lever 36, which is arranged to fit in a recess 37 on an inwardly-facing surface of the stand 15. The locking pin lever 36 is pivotably attached to the stand 15, and is resiliently biased with respect to it by means of helical spring 38. The recess 37 for the locking pin lever 36 communicates with a locking pin groove 39. A corresponding locking pin groove (not visible in these drawings), is provided on the other side of the stand 15. The stand 15 also comprises actuator ramps 40*a*, 40*b*, only one of which is visible in this drawing. There is also provided on the stand 15 a change over valve pin 41. These features will be discussed in more detail further in the specification.

When the cleaner 1 is in the position shown in FIGS. 1 and 2, it can be used in a cylinder mode, in which case the handle 3 may be released and used as a hose and wand assembly in conjunction with the hose 33. Air is drawn into the cleaner 1 through the end of the wand which can be released from the cleaner for appropriate manipulation. The inlet 12 in the cleaner head 10 is automatically shut off.

Figure 5B:
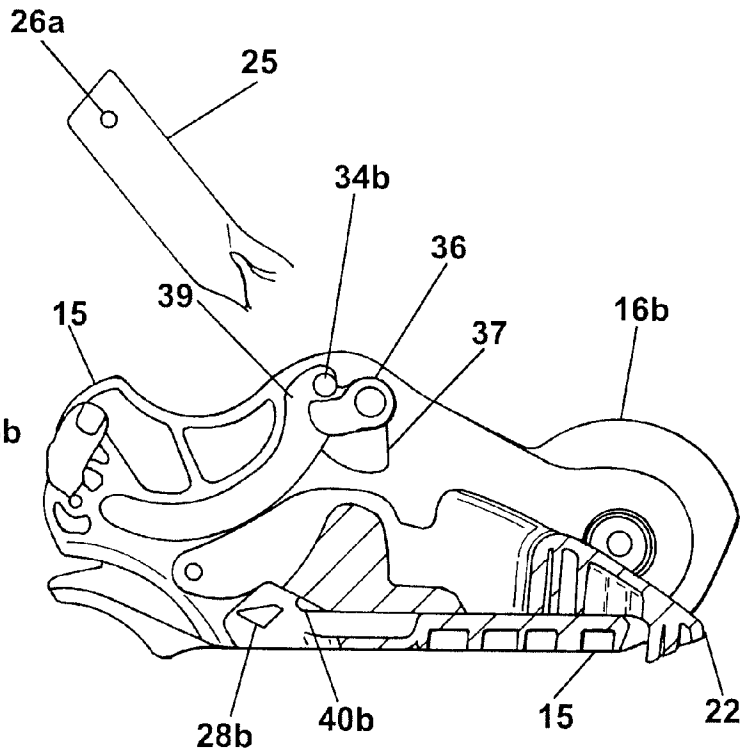
FIG. 5*b* is a sectional view along the line A-A of FIG. 5*a;*
Figure 5A:
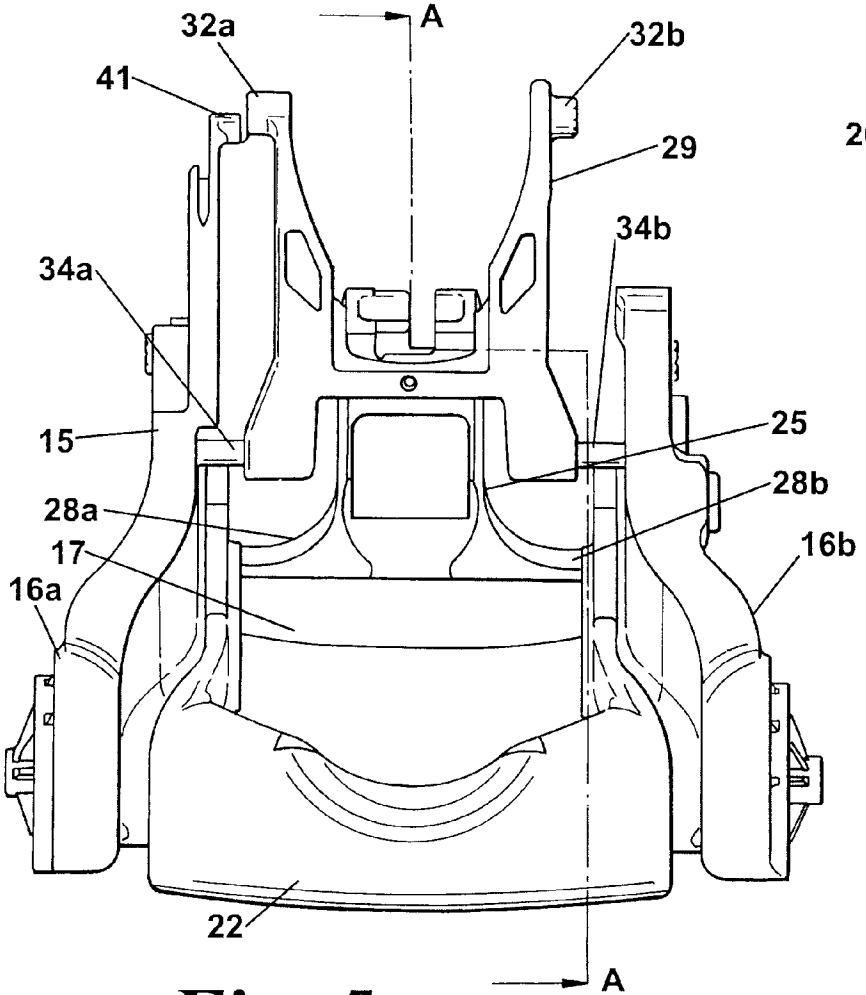
FIG. 5*a* is a plan view of some of the components of FIG. 4 in a first position.

When the cleaner 1 is to be used in conventional upright mode, the user reclines the main body 2. In order to do so, the support assembly 14 must be released from the supporting position shown in FIGS. 1 and 2. The first step is for the user to depress the pedal 22 with his foot. This is illustrated in FIGS. 5*a* and 5*b*.

The action of depressing the pedal 22 moves it out of engagement with the locking pins 34*a*, 34*b*. Thus, the weight of the main body 2 bears against the locking member 29, and the pins 34*a*, 34*b* of the locking member bear against the stand 15. The locking pin lever 36 resists movement of the pin 34*b*, and hence the locking member 29 out of this supporting position. The support assembly 14 maintains its supporting position and continues to support the main body 2, even though the pedal 22 has been depressed. This is an important safety feature, as it prevents the main body 2 from toppling backwards if the user accidentally depresses the pedal 22.

Figure 3:
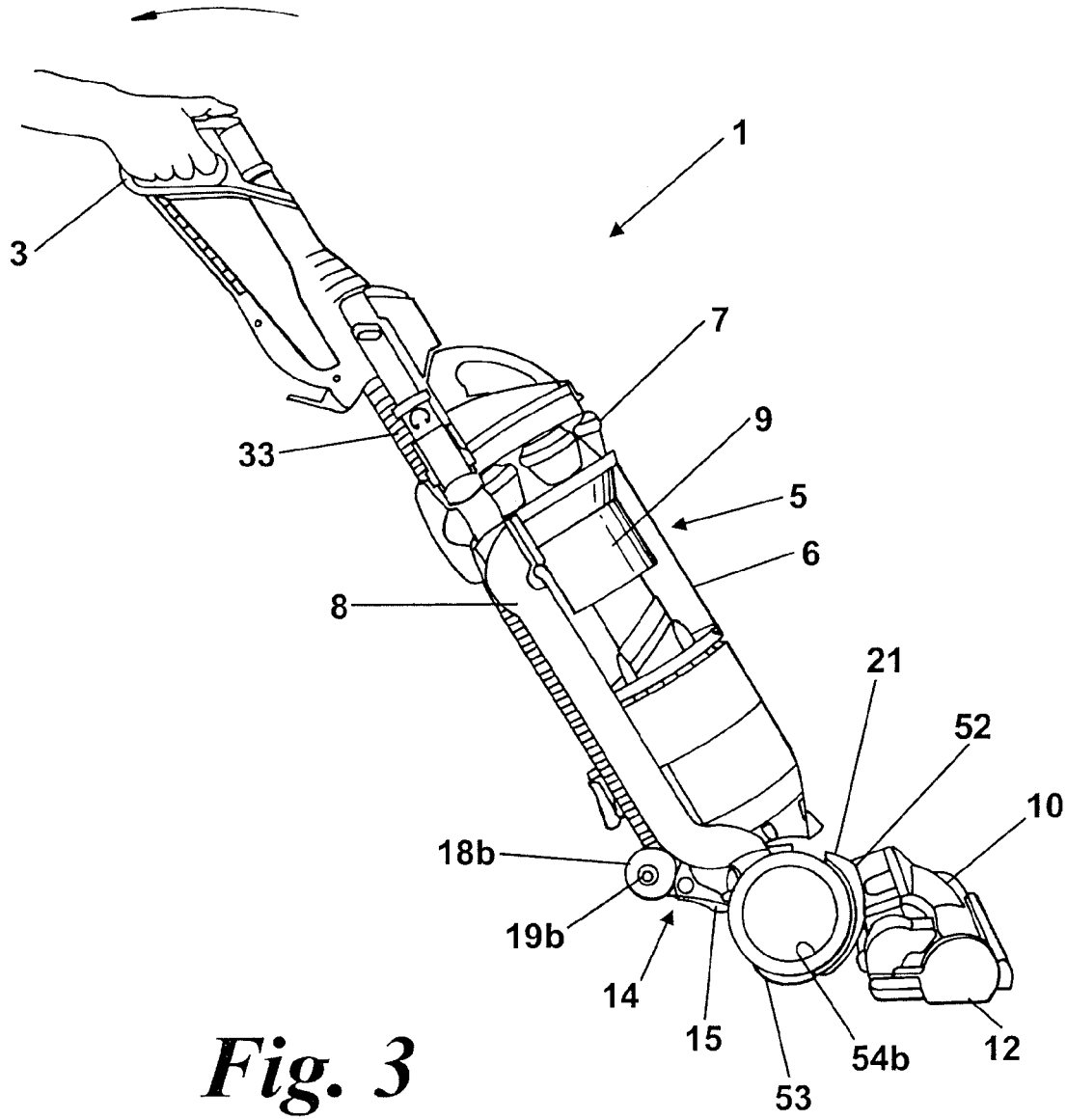
FIG. 3 is a side view of the appliance of FIGS. 1 and 2 being put into a mode of cleaning by a user.

In order to bring the support assembly 14 out of its supporting position, the user must subsequently apply a turning moment to the main body 2 by pivoting the handle 3 towards him, as illustrated in FIG. 3, to bring the main body out of its substantially vertical position. This action causes the main body 2 to bear against the locking member 29 with a force having a greater horizontal component than that experienced by the locking member when the main body 2 is vertical. Consequently, the pin 34*b* of the locking member 29 is urged against the locking pin lever 36. The force is sufficient to cause the locking pin lever 36 to pivot downwardly in its recess 37 against the force of its spring 38. This permits the pin 34*b*, and hence the pin 34*a*, to move out of their supporting position and into the locking pin grooves 39 on the stand 15. Thus, the support assembly 14 is brought out of its supporting position only when the user is supporting the cleaner 1 himself by means of the handle 3.

Figure 6B:
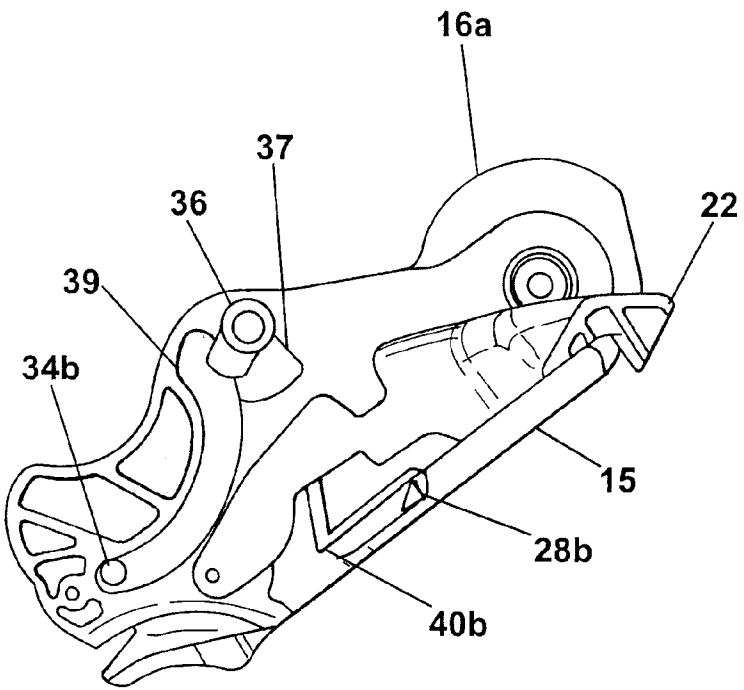
FIG. 6*b* is a sectional view along the line B-B of FIG. 6*a;*
Figure 6A:
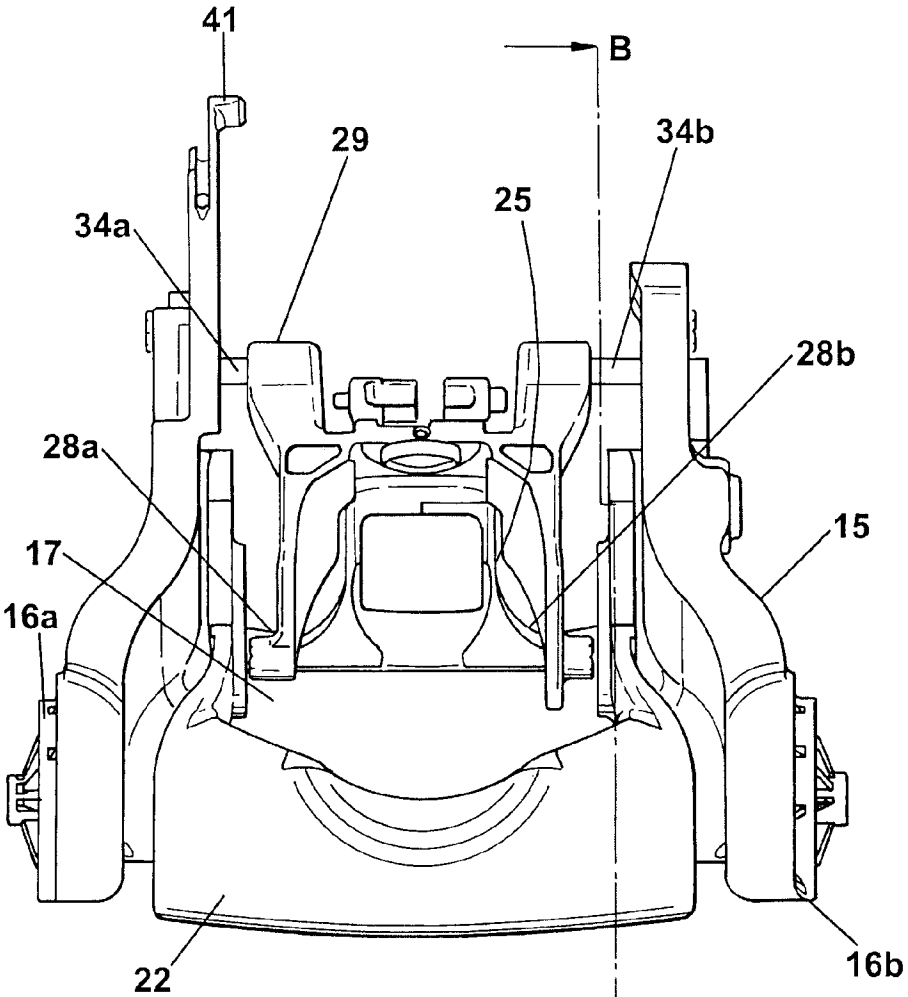
FIG. 6*a* is a plan view of the components of FIG. 5*a* in a second position.

As the user continues to recline the main body 2, the locking pins 34*a*, 34*b* slide along the grooves 39 in the stand 15. The wheels 18*a*, 18*b* on the stand remain on the floor surface and so, as the main body 2 reclines, the stand 15 is brought closer to the rear of the main body. The action of depressing the pedal 22 and sliding the stand 15 causes the arms 28*a*, 28*b* of the actuator 25 to be pushed under the actuator ramps 40*a*, 40*b* provided on the stand. Over the range of positions up to this point, the actuator 25 applied a spring force to the pedal 22, as shown in FIG. 5*b*. When the actuator arms 28*a*, 28*b*, engage with, and move along the actuator ramps 40*a*, 40*b* on the stand 15, the actuator 25 ceases to act on the pedal 22 but instead applies a spring force to the stand. Over the range of positions beyond this point, the actuator acts on the stand 15. The actuator 25 is biased so as to push upwardly against the ramps 40*a*, 40*b*, and hence urge the stand 15 upwards, as shown in FIGS. 6*a* and 6*b*. As the stand 15 pivots upwards, it lifts the wheels 18*a*, 18*b* and hence brings the support assembly 14 out of engagement with the floor surface. In the fully retracted position, as shown in FIG. 3, the support assembly 14 lies substantially against the main body 2 of the cleaner 1.

In reclining the main body 2 of the cleaner 1, the user changes the mode of cleaning from the cylinder mode, in which air is drawn through the hose and wand assembly 3, 33, to the upright mode, in which air is drawn through the head 10 of the cleaner. A change over valve 42 is required in order to connect automatically the dust separating apparatus 5 to either the wand and hose 3, 33 or the cleaner head 10, in dependence on the mode of operation. As the user reclines the main body 2 of the cleaner 1, the change over valve 42 automatically shuts off the air inlet at the distal end of the wand and connects the dust separating apparatus 5 to the cleaner head 10. The support assembly 14 is arranged to act on the change over valve 42 such that it occupies the correct position for the mode of cleaning.

Figure 7:
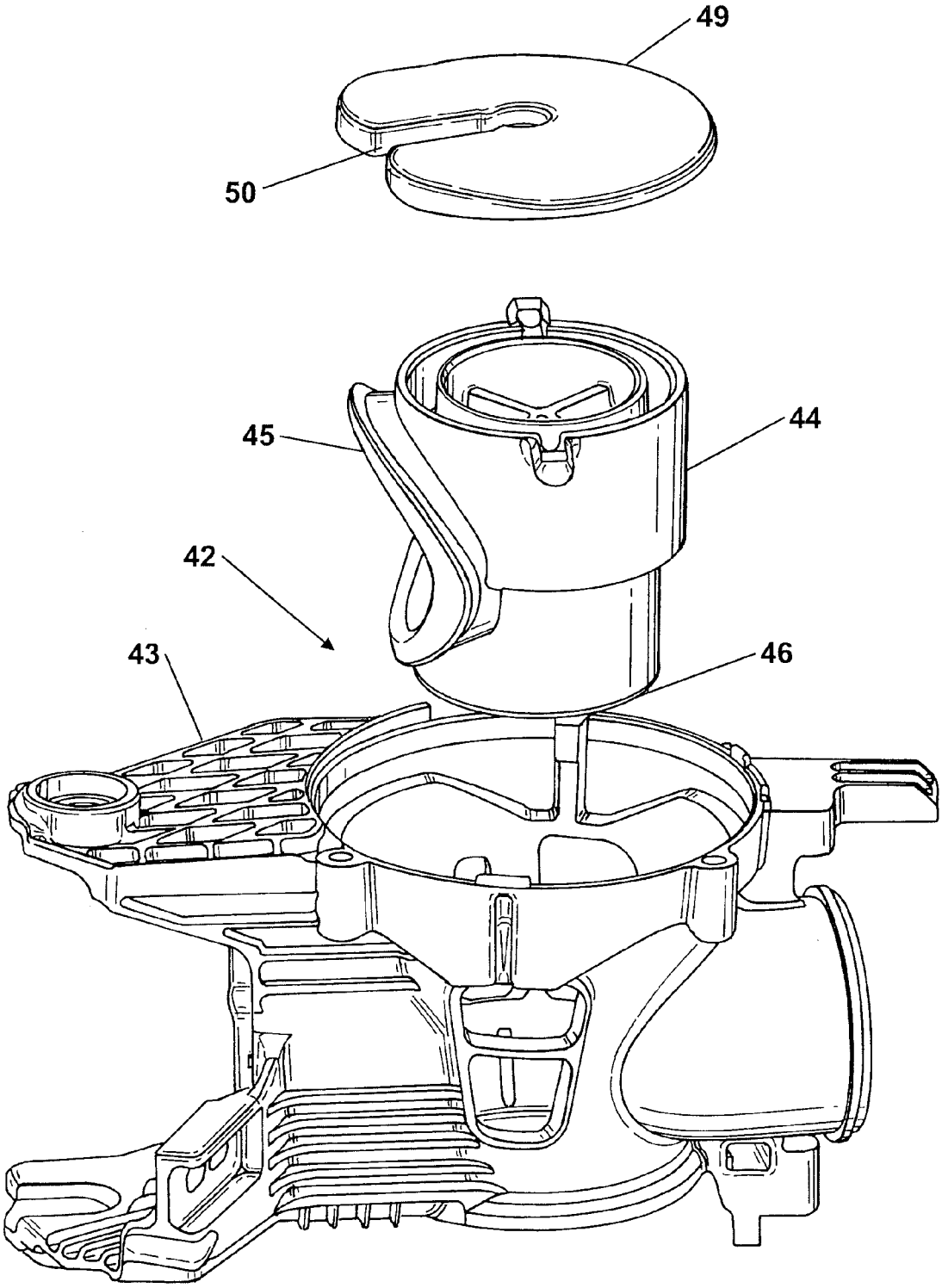
FIG. 7 is an exploded view of components of the change over valve of the appliance of FIGS. 1 to 3.
Figure 8A:
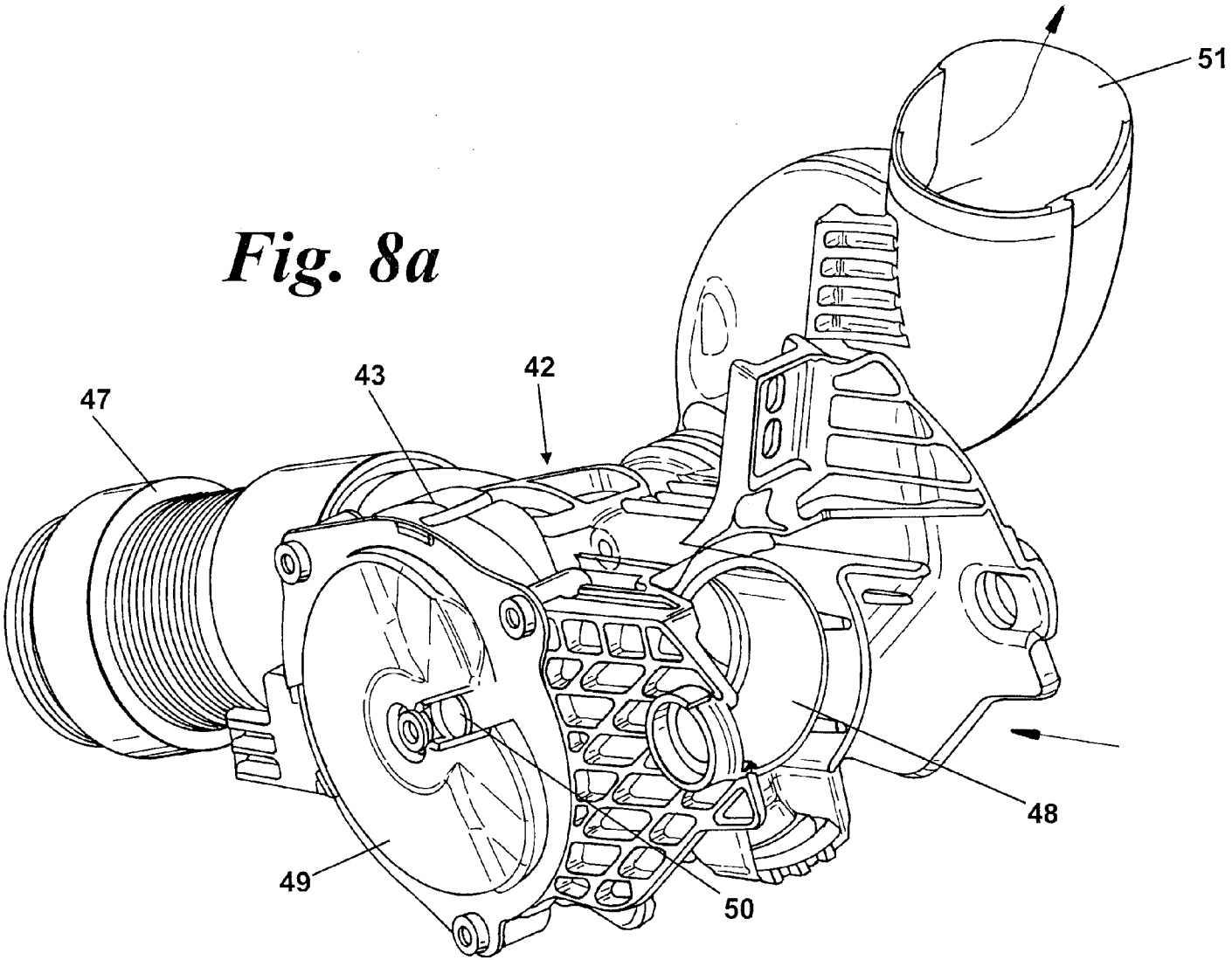
FIG. 8*a* is a perspective view of the change over valve of FIG. 7 in a first position.
Figure 8B:
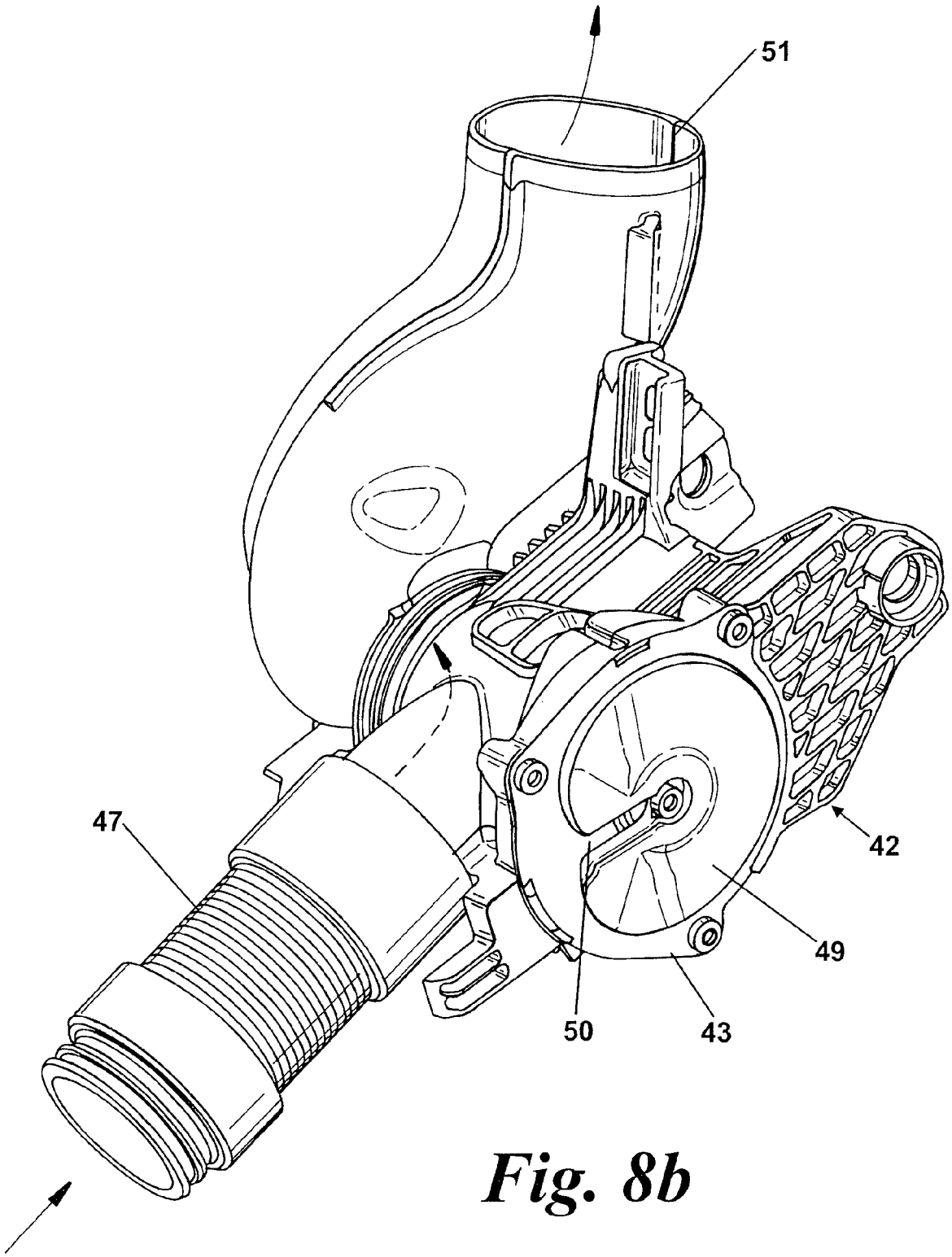
FIG. 8*b* is a perspective view of the change over valve of FIG. 7 in a second position.

The main components of the change over valve 42 are shown in the exploded view of FIG. 7. Minor components, such as seals, springs and fasteners have been omitted for clarity. The change over valve 42 comprises a casing 43 which houses a cylindrical drum 44. The drum 44 is rotatably mounted in the casing 43 such that it rotates about its longitudinal axis. The drum 44 has an inlet 45 on its circumference and an outlet 46 at one end. The drum 44 defines a fluid flow path. The position of the drum 44 determines the mode of cleaning. FIGS. 8*a* and 8*b* illustrate the position of the change over valve 42 in the two modes of cleaning. The hose 47, connected at one end portion of the casing 43 is internal to the cleaner head 10 and so defines the fluid outlet from the air inlet 12 on the cleaner head. The opening 48 at the other end of the casing 43 is arranged to connect with the main hose 33 and so defines the fluid outlet from the hose and wand assembly 3, 33. A wheel 49 is connected to the rotational axis of the drum 44. Rotation of the wheel 49 causes the drum 44 to move between the positions defining the cleaning modes. A slot 50 in the circumference of the wheel 49 corresponds approximately to the position of the fluid inlet 45 on the circumference of the drum 44.

In the position shown in FIG. 8*a*, the cleaner is in cylinder mode, with the inlet 45 of the drum 44 facing the opening 48. The cleaner head hose 47 is closed off. Air is drawn through the hose and wand assembly 3, 33, into the change over valve 42 and exits the outlet 46 of the drum 44 into a fluid conduit 51. The fluid conduit 51 leads to the duct 8 connected to the dirt and dust separating apparatus 5.

In the position shown in FIG. 8*b*, the cleaner is in upright mode, with the inlet 45 of the drum facing the cleaner head hose 47. The opening 48 that communicates with the hose and wand assembly 3, 33 is closed off. Air is drawn through the cleaner head 10 via the inlet 12, into the change over valve 42 and exits the outlet 46 of the drum 44 into the fluid conduit 51.

Figure 9A:
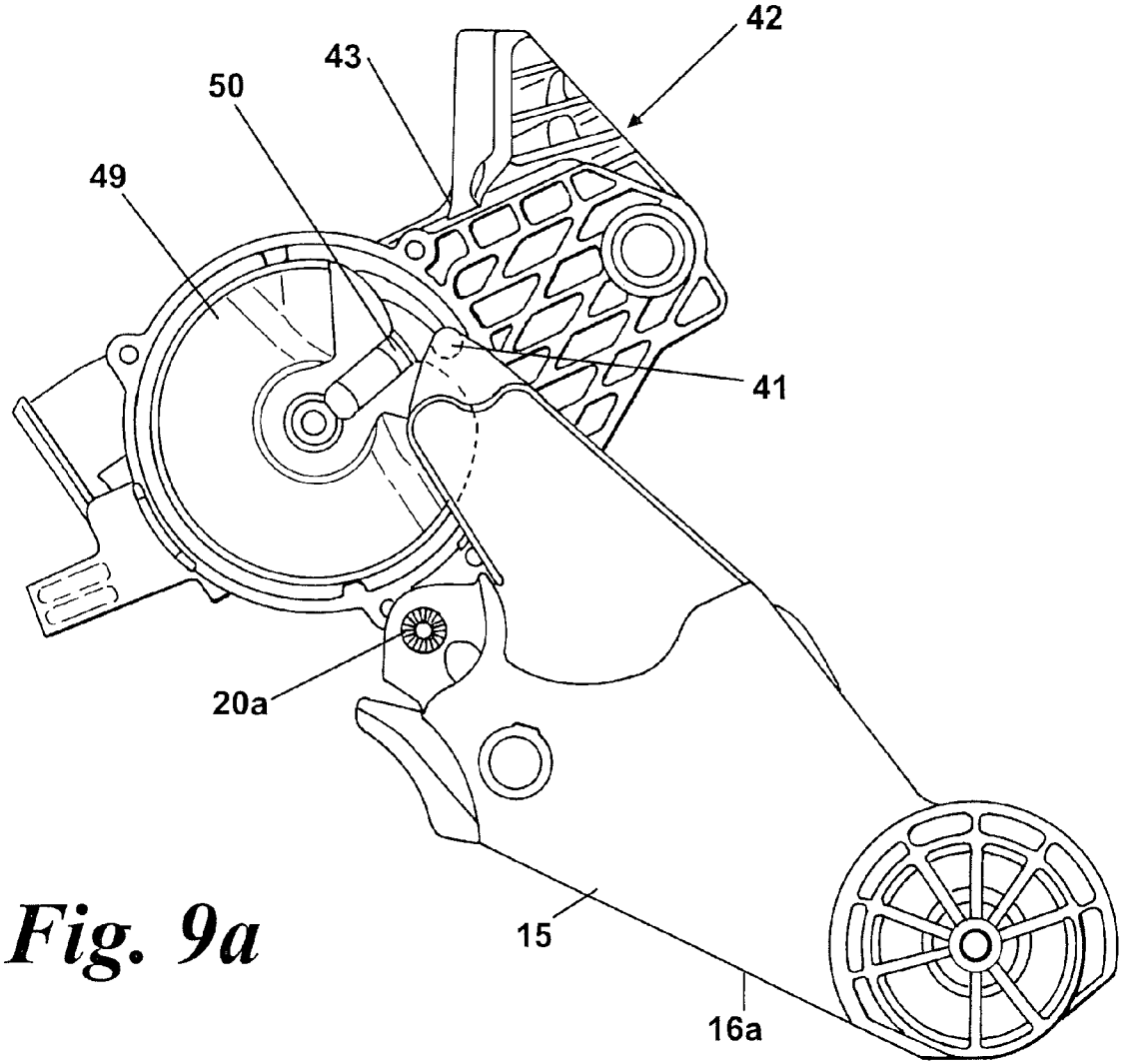
FIG. 9*a* is a side view of part of the support assembly of FIG. 4 and the change over valve of FIG. 7 in the first position.
Figure 9B:
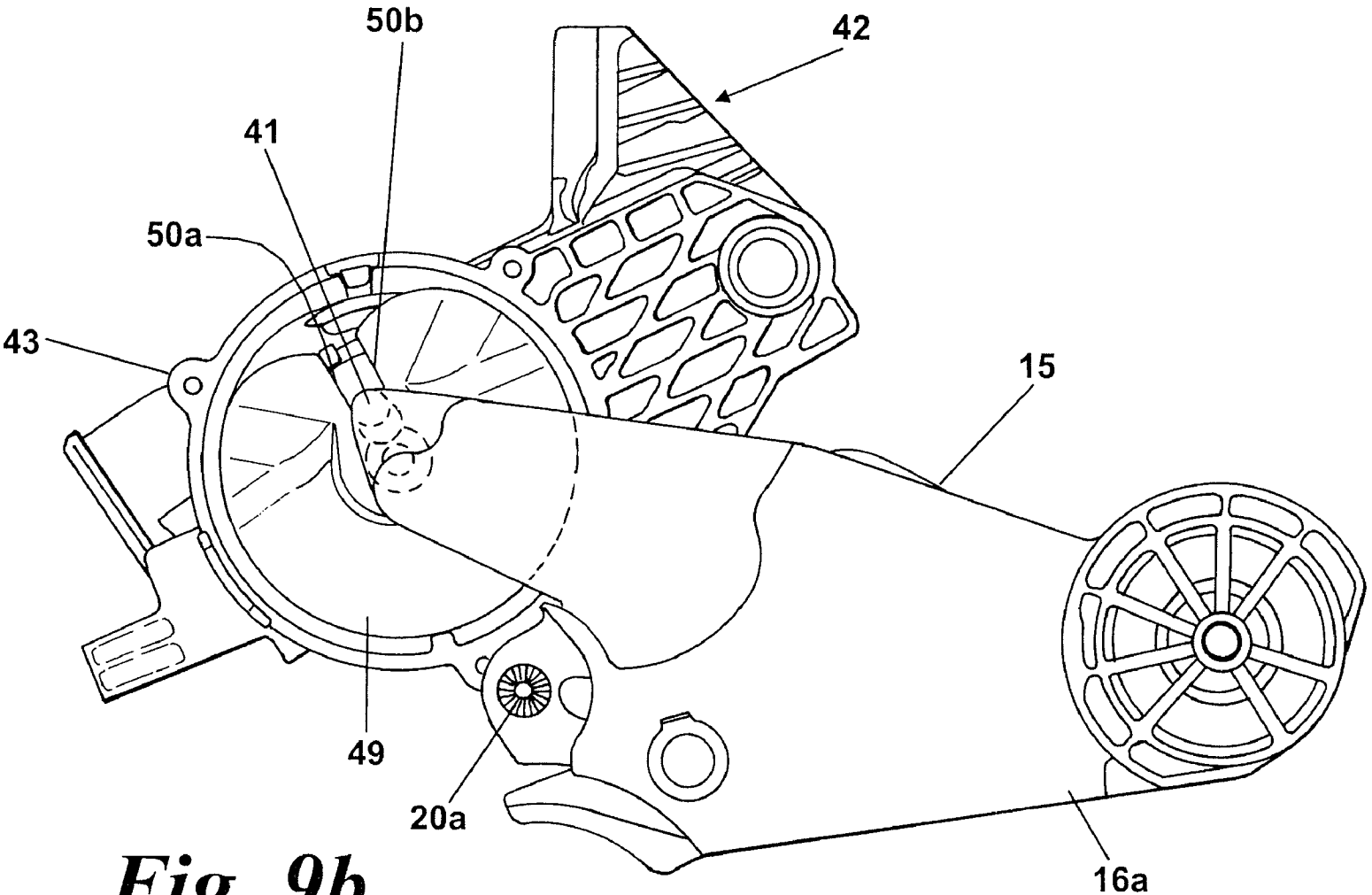
FIG. 9*b* is a side view of the components of FIG. 9*a* in an intermediary position.
Figure 9C:
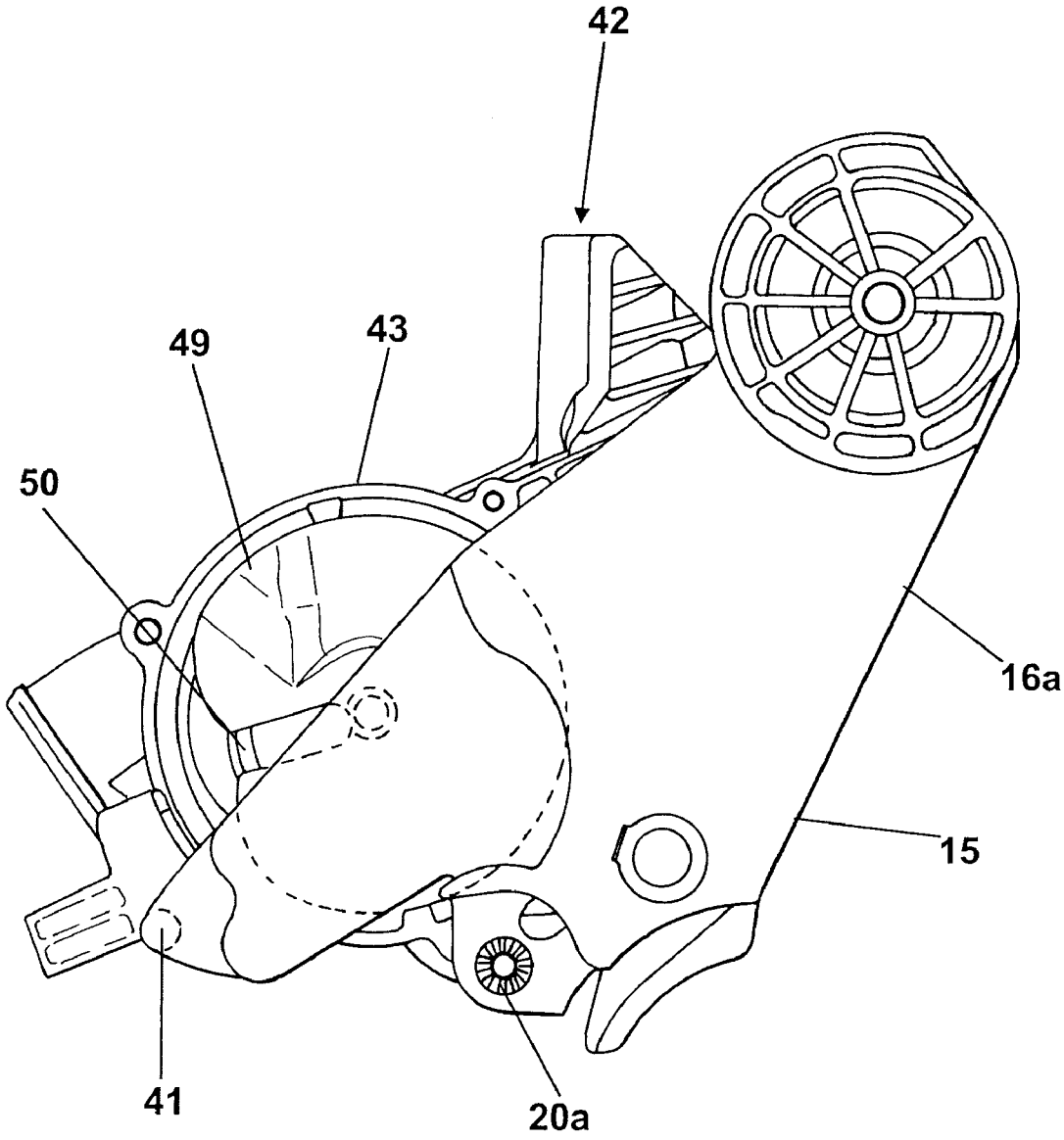
FIG. 9*c* is a side view of the components of FIG. 9*a* in the second position.

Whilst the user is reclining the main body 2 of the cleaner 1, the stand 15 moves pivotably relative to the main body. The change over valve pin 41 on the stand 15 engages with the slot 50 on the wheel 49 of the change over valve 42. FIG. 9*a* illustrates the point at which the change over valve pin 41 enters the opening of the slot 50. The change over valve pin 41 bears against a wall 50*a* of the slot and induces the wheel 49 to rotate, as shown in FIG. 9*b*. Thus, the pivoting motion of the stand 15 is translated into rotational motion of the drum 44 of the change over valve 42, in the manner of a Geneva drive. As the user moves the main body 2 into the reclined position, so that the stand 15 is urged upwards, the change over valve 42 is caused to rotate from the cylinder mode to the upright mode. The stand then continues to move into its fully retracted position, as shown in FIG. 9*c*.

Another function of the support assembly 14 is to control the locking and release of the cleaner head 10. When the main body 2 is in the vertical position, with the support assembly 14 in the supporting position, the cleaner head 10 is latched with respect to the main body 2. This enables the user to tilt the cleaner 1 as a whole onto the wheels 18*a*, 18*b* of the support assembly 14 so that the cleaner can be wheeled from location to location without the cleaner head 10 drooping and obstructing manoeuvrability. The support assembly 14 is arranged to release the cleaner head 10 from this position as it moves into the retracted position so that, as the main body 2 of the cleaner 1 is reclined, the head remains in contact with the surface to be treated.

The cleaner head 10 is connected to the main body 2 of the vacuum cleaner 1 in such a manner that the cleaner head 10 remains in contact with a floor surface as the main body is manoeuvred through a wide range of operating positions, e.g. when moved from side-to-side or when the main body is twisted about its longitudinal axis. The yoke 21 connects the main body 2 to the cleaner head 10. The yoke 21 is mounted to each end of a rotational axis of the roller assembly 4. The yoke 21 can pivot independently of the main body 2. At the forward, central part of the yoke 21 there is a joint 52, which connects to the cleaner head 10.

The main body 2 is rotatably connected to the roller assembly 4, which lies at the base of the main body. The roller assembly 4 allows the apparatus to be easily pushed or pulled along a surface. The shape of the roller assembly 4 and the connections between the main body 2 and the roller assembly, and the roller assembly and the cleaner head 10, allow the apparatus to be more easily manoeuvred than traditional vacuum cleaners.

The roller assembly 4 comprises a central roller 53 and a pair of outer rollers 54*a*, 54*b*, which are arranged relative to each other so as to provide a rolling support surface, but with rotational axes that are spaced from each other. The central roller 53 comprises an elongated and barrel-shaped shell, which shape provides both stability and manoeuvrability. A plurality of ridges 55 are provided around its circumference, to provide extra grip as the cleaner 1 is rolled along a surface to be treated. The outer rollers 54*a*, 54*b* are cap-shaped, having a larger diameter than the maximum diameter of the central roller 53 but a relatively narrow rolling support surface. This arrangement of rollers delimits a region into which components of the vacuum cleaner 10 may be mounted. In this embodiment, the region houses the change over valve mechanism 42 and also provides a space into which components of the support assembly 14 can fold into when the cleaner 1 is being used for upright cleaning. Thus, components of the support assembly 14 are hidden from the user when the support assembly is in the retracted position. This prevents the components from being damaged or tampered with, as well as being more aesthetically pleasing.

The arrangement of the pivotal mounting of the yoke 21 and joint 52 allows the main body 2 together with the roller assembly 4 to be rotated about the longitudinal axis 56 of the handle 3, in the manner of a corkscrew, while the cleaner head 10 remains in contact with the floor surface. This arrangement also causes the cleaner head 10 to point in a new direction as the main body 2 is rotated about its longitudinal axis 56.

Figure 10:
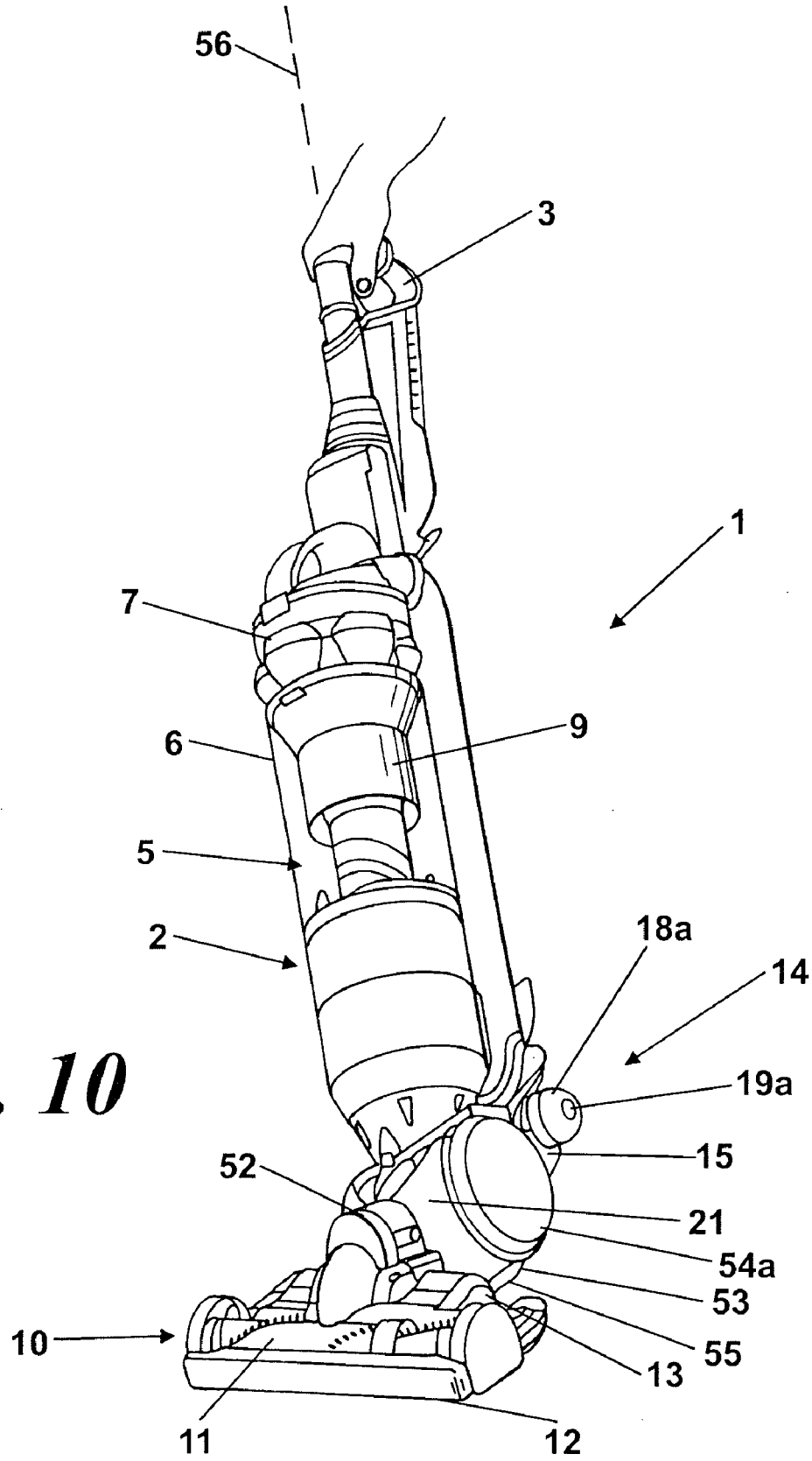
FIG. 10 is a perspective view of the appliance in a mode of use.

FIG. 10 shows the vacuum cleaner in a turning position. The user rotates the main body 2 about its longitudinal axis 56 by means of the handle 3. This causes the roller assembly 4 to tilt with respect to the floor. The joint 52 associated with the yoke 21 causes the cleaner head 10 to turn whilst remaining in contact with the floor. The extent to which the main body 2 is turned about its longitudinal axis 56 determines the extent to which the cleaner head 10 moves from its forward facing position towards the right or left. The support assembly 14 remains neatly tucked up against the rear of the main body 2 during this range of motions performed by the cleaner 1. This permits the user easily to manoeuvre the cleaner 1, even when cleaning under furniture and other low obstructions.

Figure 11:
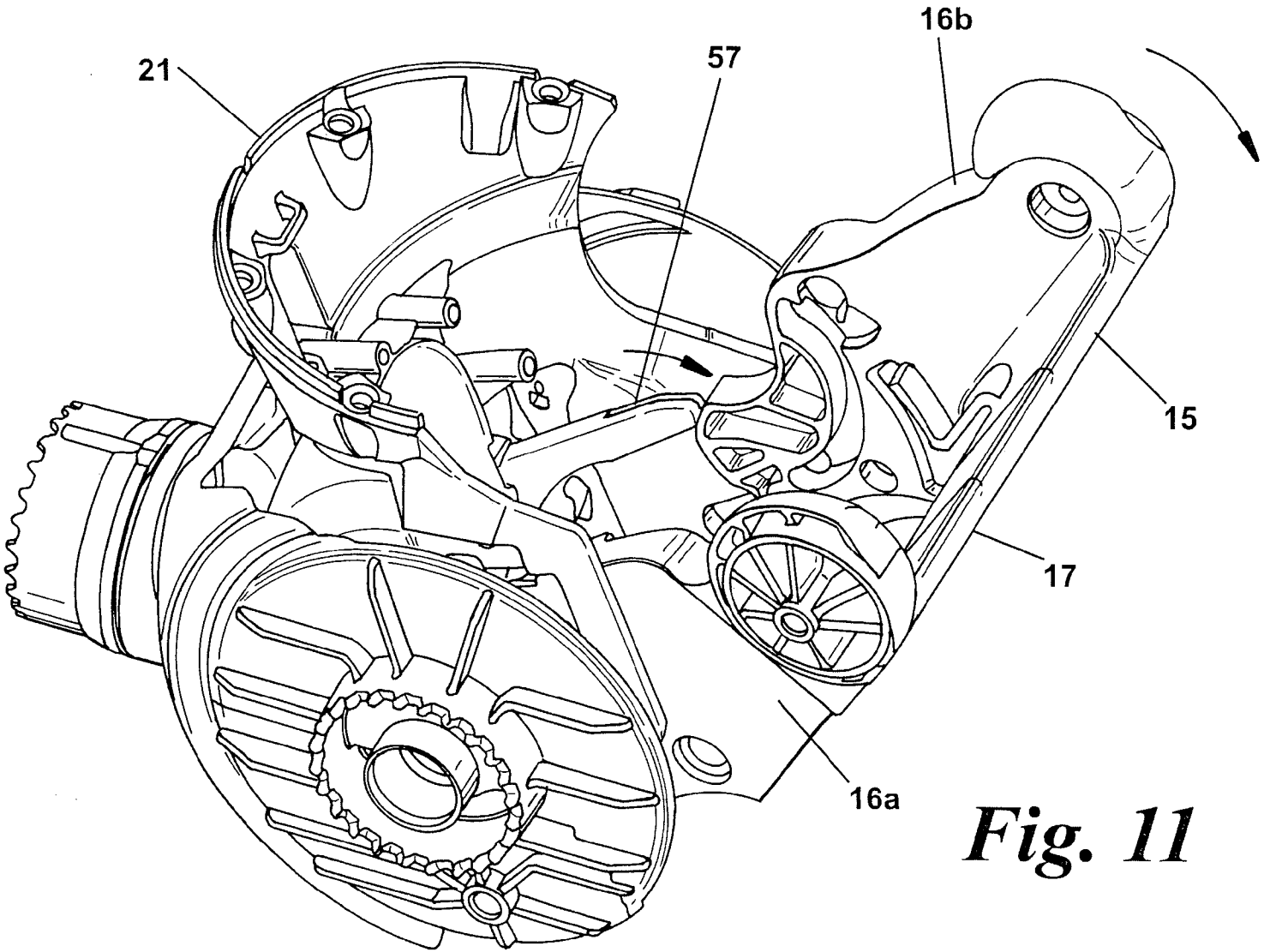
FIG. 11 is a perspective view of part of the appliance including a component of the support assembly.
Figure 12:
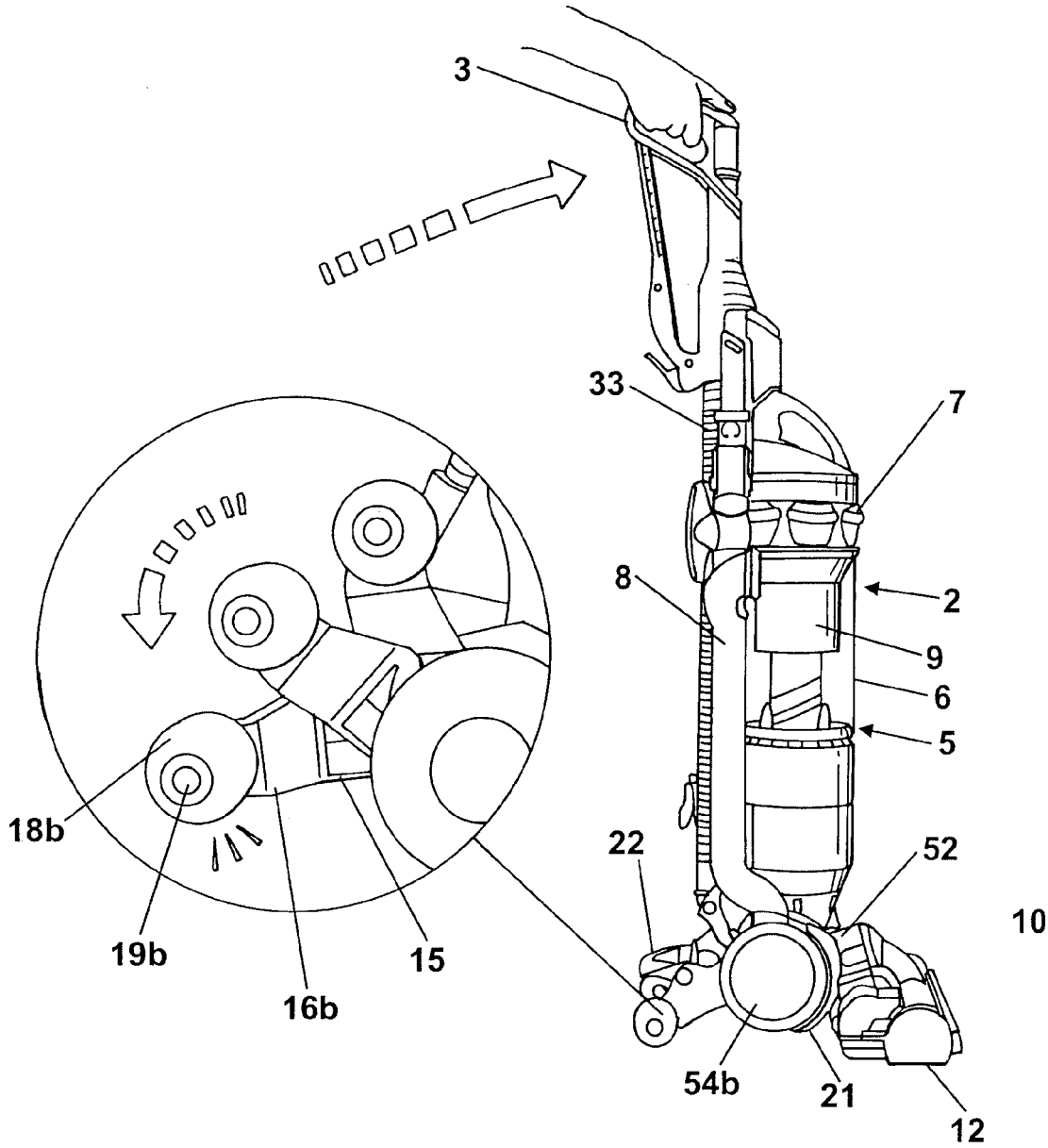
FIG. 12 is a side view of the appliance being returned to the position of FIG. 1.

When the user wishes to return the cleaner 1 to the vertical position, he pivotally moves the main body 2 back towards the vertical, as indicated by the arrow in FIG. 12. As the main body 2 rotates, an arm 57 fixed to the yoke 21 bears against a surface of the stand 15, as shown in FIG. 11. The arm 57 pushes the stand 15 out of its retracted position against the main body 2. The stand 15 moves away from the main body 2 and, as it does so, pivots downwardly towards the floor surface.

The change over valve pin 41 on the stand 15 re-engages with the slot 50 on the wheel 49 of the change over valve 42. The change over valve pin 41 bears against the other side wall 50*b* of the slot and induces the wheel 49 to rotate in the opposite direction to that when the stand 15 was being retracted. As the user moves the main body 2 from its reclined position back into the vertical position, the change over valve 42 is caused to rotate from the upright mode to the cylinder mode. The motion of the stand 15 and valve 42 is the same as that shown in FIGS. 9*a* to 9*c*, but in reverse.

The pins 34*a*, 34*b* of the locking member 29 ride along the grooves 39 in the stand 15 as it moves out of the retracted position and cause the locking member to pivot outwardly from the main body 2. When moving from the retracted position into the supporting position, the locking pins 34*a*, 34*b* are arranged to move along the upper surfaces of the grooves. Hence the locking pin 34*b* moves over the locking pin lever 36 and into the top end of its groove 39. As the main body 2 returns to its vertical position, the locking pin 34*b* is prevented from sliding back along the groove 39 by the locking pin lever 36.

The arms 28*a*, 28*b* of the actuator 25 slide along the actuator ramps 40*a*, 40*b* provided on the stand 15, as the stand moves relative to the main body 2. The actuator 25 continues to apply an upwardly-directed spring force to the stand 15, but the force of the yoke arm 57 against the stand overcomes this spring force and prevents the stand from being urged back into the retracted position. When the actuator arms 28*a*, 28*b* reach the ends of the ramps 40*a*, 40*b*, the actuator 25 ceases to act on the stand 15. Therefore, the spring force urging the stand 15 upwards is released. Hence, the stand 15 falls under the influence of gravity towards the floor surface and pivots so that its wheels 18*a*, 18*b* resume engagement with the floor. The actuator 25, freed from the constraints of the ramps 40*a*, 40*b*, pivots upwards under the influence of the spring and re-engages the pedal 22. The actuator 25 urges the pedal 22 upwards, so that the notches 35*a*, 35*b* on the pedal re-engage with the pins 34*a*, 34*b* of the locking member 29. In this manner, the cleaner 1 is returned to its vertical position and the support assembly 14 supports the main body of the cleaner.

The components may be arranged to produce a click or other sound, to indicate to the user that the appliance has been fully returned to the vertical position. Thus, the user releases the handle 3, leaving the main body 2 to be supported by the support assembly 14.

Of course, variations may be made without departing from the scope of the invention. For example, the support assembly 14 may be coupled to the brush bar 11, so that the brush bar, or other agitator, is driveable only as the user reclines the main body 2 for upright cleaning. This prevents the brush bar 11 from being energised when the cleaner is in the vertical position, when it may be stationary for an extended period of time. Thus, excessive wear and tear on the floor surface is prevented. The support assembly may further be arranged to cause the agitator to be driven automatically as the main body 2 is reclined, without the need for selective energisation by the user. Similarly, the support assembly 14 may be arranged automatically to interrupt driving of the agitator when the main body 2 is returned to the vertical position.

The provision of a depressible pedal 22 makes the cleaner user-friendly when converting from cylinder-type cleaning to upright cleaning. However, the foot pedal may be replaced by some other user-operable mechanism, such as a handle, lever or catch.

It is possible that some users may not acknowledge the presence of the pedal or other user-operable device and may be more familiar with cleaners in which the conversion between cylinder and upright modes is effected by pushing down on the cleaner head 10 itself as the body 2 is reclined. Therefore, the support assembly 14 may be arranged so as to release the cleaner head 10 from its latched position in the event that a downward force over a predetermined limit is applied to the cleaner head. This allows the head 10 to drop down onto the floor surface for upright-type cleaning. When the main body 2 is returned to the vertical position, the support assembly re-sets itself, so that the user can subsequently recline the main body 2 in the correct manner by means of the pedal 22. This feature prevents the cleaner head 10 from being damaged if the user tries to deploy the cleaner head in the wrong manner.

It is also possible that a user may misuse the appliance, or else be unaware of the operation of the support assembly, and may try to move the components manually. The support assembly 14 is arranged to be completely self-resetting when the main body 2 is returned to the vertical position. This feature ensures that the sequence of operations activated by the support assembly does not get out of synchronisation if the cleaner 1 is used incorrectly.

While the illustrated embodiment shows a vacuum cleaner in which ducts carry airflow, it will be appreciated that the invention can be applied to cleaners which carry other fluids, such as water and detergents.

Separation of dust from the airflow could equally be carried out using other means such as a conventional bag-type filter, a porous box filter, an electrostatic separator or some other form of separating apparatus. For embodiments of the apparatus which are not vacuum cleaners, the main body can house equipment which is appropriate to the task performed by the machine. For example, for a floor polishing machine the main body can house a tank for storing liquid wax The brush bar 11 can be driven in other ways, such as by a turbine which is driven by incoming or exhaust airflow, or by a coupling to the motor which is also used to drive the suction fan. The coupling between the motor and brush bar can alternatively be via a geared coupling. In alternative embodiments the brush bar can be removed entirely so that the machine relies entirely on suction or by some other form of agitation of the surface. For other types of surface treating machines, the cleaner head can include appropriate means for treating the floor surface, such as a polishing pad, a liquid or wax dispensing nozzle etc. The lower face of the cleaner head can include small rollers to ease movement across a surface.

The invention claimed is:

1. A surface treating appliance comprising a device generating a flow of fluid, a main body, a hose, a surface treating head and a rotary change over valve, the valve being selectively rotatable so as to allow fluid flow from either the surface-treating head or the hose, and a support assembly moveable between a supporting position, in which the support assembly supports the main body, and a retracted position, the change over valve and support assembly being arranged so that motion of the support assembly between the supporting and retracted positions induces rotary motion of the change over valve.

2. The appliance of claim 1, in which the rotary valve comprises a drum having a fluid inlet and a fluid air outlet, one of the inlet and outlet being on the circumference of the drum, the other of the inlet and outlet being on an end face of the drum.

3. The appliance of claim 1, in which the support assembly comprises a stand arranged to engage a floor surface in the supporting position and to move pivotably with respect to the main body as the support assembly moves between the supporting to retracted positions.

4. The appliance of claim 3, in which pivoting motion of the stand between the positions is converted into rotary motion of the change over valve.

5. The appliance of claim 3, in which a pin on the stand is arranged to engage a slot on the change over valve as the support assembly moves between the supporting and retracted positions.

6. The appliance of claim 3, in which the valve is arranged to allow fluid flow from the hose when the support assembly is in the supporting position.

7. The appliance of claim 3, in which the valve is arranged to allow fluid flow from the surface-treating head when the support assembly is in the retracted position.

8. The appliance of claim 1, further comprising a user-operable handle on the main body.

9. The appliance of claim 1, further comprising a roller assembly which is rotatably mounted to the main body for allowing the main body to be moved along a surface.

10. The appliance of claim 9, in which the roller assembly comprises a central roller arranged to engage a floor surface and a pair of outer rollers at respective ends of the central roller, the rollers defining a substantially continuous rolling support surface, each outer roller having a rotational axis spaced from that of the central roller.

11. The appliance of claim 10, in which the rollers delimit a region housing at least one component.

12. The appliance of claim 11, in which the component includes the change over valve.

13. The appliance of claim 11, in which the component includes parts of the support assembly.

14. The appliance of claim 11, in which the component includes parts of the support assembly when in the retracted position.

15. The appliance of claim 1, in which the support assembly further comprises at least one wheel for allowing the appliance to be rolled along a surface.

16. The appliance of claim 1, in which the support assembly is located on a rear portion of the appliance.

17. The appliance of claim 1, in which the surface-treating head is arranged in a fixed position with respect to the main body when the support assembly is in the supporting position.

18. The appliance of claim 17, in which the surface-treating head is arranged to bear against a floor surface when the support assembly is moved out of the supporting position.

19. The appliance of claim 17, in which the surface-treating head is arranged so that the user can cause it to engage with a floor surface by applying downwardly-directed force above a predetermined value to the head.

20. The appliance of claim 1, further comprising a linkage between the main body and the surface-treating head arranged such that rotating the main body about its longitudinal axis causes the head to point in a new direction.

21. The appliance of claim 1, in which the surface-treating head has a driveable agitator.

22. The appliance of claim 21, in which the agitator is driveable when the support assembly is brought out of the supporting position.

23. The appliance of claim 22, in which the agitator is automatically driven when the support assembly is brought out of the supporting position.

24. The appliance of claim 21, in which the agitator is prevented from being driven when the support assembly is in the supporting position.

25. The appliance of claim 21, in which the agitator is a brush bar.

26. A vacuum cleaner comprising the appliance of claim 1.

27. The vacuum cleaner of claim 26, further comprising a cyclonic dirt and dust separating device.

* * * * *